US008852064B2

(12) United States Patent
Hoover et al.

(10) Patent No.: US 8,852,064 B2
(45) Date of Patent: Oct. 7, 2014

(54) REDUCED FEED ROLL WEAR USING CARBON NANOTUBE ADDITIVES IN RUBBERS

(75) Inventors: Linn C. Hoover, Webster, NY (US); Kock-Yee Law, Penfield, NY (US)

(73) Assignee: Xerox Corporation, Norwalk, CT (US)

( * ) Notice: Subject to any disclaimer, the term of this patent is extended or adjusted under 35 U.S.C. 154(b) by 1239 days.

(21) Appl. No.: 12/423,107

(22) Filed: Apr. 14, 2009

(65) Prior Publication Data

US 2010/0258238 A1 Oct. 14, 2010

(51) Int. Cl.
*D01F 9/12* (2006.01)
*B65H 3/06* (2006.01)

(52) U.S. Cl.
CPC .... *B65H 3/0638* (2013.01); *G03G 2215/00679* (2013.01); *G03G 2215/00683* (2013.01); *B65H 2401/11* (2013.01); *B65H 2402/80* (2013.01); *B65H 2404/1112* (2013.01); *B65H 2404/14* (2013.01); *B65H 2404/55* (2013.01); *B65H 2601/423* (2013.01); *B65H 2601/522* (2013.01); *B65H 2801/06* (2013.01); *B65H 2404/187* (2013.01)
USPC ..... 492/28; 492/53; 492/56; 492/59

(58) Field of Classification Search
CPC ..... G03G 15/0233; G03G 15/0818; G03G 2215/025; G03G 2215/2058–2215/2067; G03G 2215/00683; G03G 15/2057
USPC ..... 492/28, 16, 17, 18, 53, 56, 59; 271/109
See application file for complete search history.

(56) References Cited

U.S. PATENT DOCUMENTS

| | | | | |
|---|---|---|---|---|
| 2004/0260006 | A1 | 12/2004 | Mabuchi et al. | |
| 2005/0218582 | A1 * | 10/2005 | Mine et al. | 271/109 |
| 2006/0067871 | A1 * | 3/2006 | Hart et al. | 423/447.3 |
| 2006/0103711 | A1 * | 5/2006 | Kodama et al. | 347/104 |
| 2006/0290047 | A1 * | 12/2006 | Moore | 271/10.11 |

FOREIGN PATENT DOCUMENTS

| | | |
|---|---|---|
| EP | 1 428 673 | 6/2004 |
| JP | 2004101958 | 4/2004 |
| JP | 2005-280964 | 10/2005 |
| JP | 2005-314019 | 11/2005 |
| JP | 2006107356 | 4/2006 |
| JP | 2007-137539 | 6/2007 |
| WO | 03/060002 | 7/2003 |

OTHER PUBLICATIONS

European Patent Office Communication, European Search Report from European Patent Application No. 10158710.3 dated Feb. 1, 2013, 4 Pages.

* cited by examiner

*Primary Examiner* — Christopher Besler
(74) *Attorney, Agent, or Firm* — MH2 Technology Law Group LLP

(57) ABSTRACT

In accordance with the invention, there are media feeding assemblies and methods of making a roll of a media feeding assembly. The method can include providing a soluble carbon nanotube composition, providing a first elastomeric rubber composition, and mixing the soluble carbon nanotube composition with the first elastomeric rubber composition to form a composite rubber composition, such that the soluble carbon nanotubes are substantially uniformly dispersed in the composite rubber composition. The method can also include applying the composite rubber composition to a mold and curing the composite rubber composition to form a composite rubber tire, such that the substantially uniformly dispersed soluble carbon nanotubes in the composite rubber tire provide at least about 10% decrease in wear.

9 Claims, 5 Drawing Sheets

REDUCED FEED ROLL WEAR USING CARBON NANOTUBE ADDITIVES IN RUBBERS

FILED OF THE INVENTION

The present invention relates to a media feeding assembly and, more particularly, to methods of making rolls of a media feeding assembly.

BACKGROUND OF THE INVENTION

Elastomeric rubbers such as, urethane, silicone, and ethylene propylene diene M-class rubber are typically used to mold tires for various rolls (e.g., nudger roll, feed roll, retard roll, take away roll) of a media feed assembly. Tire life is defined by the smallest number of sheets fed before either: 1) the tire to media coefficient of friction (Cof) drops below a minimum value required to acquire and feed a sheet of media resulting in mis-feeds or 2) abrasion between the tire and media reduces the tire diameter to a minimum diameter or causes the tire to not run true and exceeds a maximum runout. Small diameter tires can allow the media to interfere with mechanical components in the feed head while run out skews the media's lead edge during the acquisition and feed cycles. Significant development work is required to find the correct elastomer with properties that balance tire coefficient of friction versus the abrasion resistance to achieve maximum effective roll life.

Accordingly, there is a need to overcome these and other problems of prior art to provide rolls of media feeding assembly with improved wear resistance and methods of making them.

SUMMARY OF THE INVENTION

In accordance with various embodiments, there is a media feeding assembly including a first drive roll configuration having a first nip disposed along an axis of a media feed path, the first drive roll configuration including one or more rolls. The media feeding assembly can also include a second drive roll configuration having a second nip disposed at a distance from the first drive roll pair, the second drive roll configuration including one or more rolls, wherein the one or more rolls of the first and the second drive roll configurations can include a composite rubber tire over a roll core, the composite rubber tire including a plurality of soluble carbon nanotubes dispersed in a first elastomeric rubber to provide at least about 10% decrease in wear.

According to various embodiments, there is a method of making a roll of a media feeding assembly. The method can include providing a soluble carbon nanotube composition, providing a first elastomeric rubber composition, and mixing the soluble carbon nanotube composition with the first elastomeric rubber composition to form a composite rubber composition, such that the soluble carbon nanotubes are substantially uniformly dispersed in the composite rubber composition. The method can also include applying the composite rubber composition to a mold and curing the composite rubber composition to form a composite rubber tire, such that the substantially uniformly dispersed soluble carbon nanotubes in the composite rubber tire provide at least about 10% decrease in wear.

Additional advantages of the embodiments will be set forth in part in the description which follows, and in part will be obvious from the description, or may be learned by practice of the invention. The advantages will be realized and attained by means of the elements and combinations particularly pointed out in the appended claims.

It is to be understood that both the foregoing general description and the following detailed description are exemplary and explanatory only and are not restrictive of the invention, as claimed.

The accompanying drawings, which are incorporated in and constitute a part of this specification, illustrate embodiments of the invention and together with the description, serve to explain the principles of the invention.

DESCRIPTION OF THE EMBODIMENTS

Reference will now be made in detail to the present embodiments, examples of which are illustrated in the accompanying drawings. Wherever possible, the same reference numbers will be used throughout the drawings to refer to the same or like parts.

Notwithstanding that the numerical ranges and parameters setting forth the broad scope of the invention are approximations, the numerical values set forth in the specific examples are reported as precisely as possible. Any numerical value, however, inherently contains certain errors necessarily resulting from the standard deviation found in their respective testing measurements. Moreover, all ranges disclosed herein are to be understood to encompass any and all sub-ranges subsumed therein. For example, a range of "less than 10" can include any and all sub-ranges between (and including) the minimum value of zero and the maximum value of 10, that is, any and all sub-ranges having a minimum value of equal to or greater than zero and a maximum value of equal to or less than 10, e.g., 1 to 5. In certain cases, the numerical values as stated for the parameter can take on negative values. In this case, the example value of range stated as "less that 10" can assume negative values, e.g. −1, −2, −3, −10, −20, −30, etc.

Figure 1:
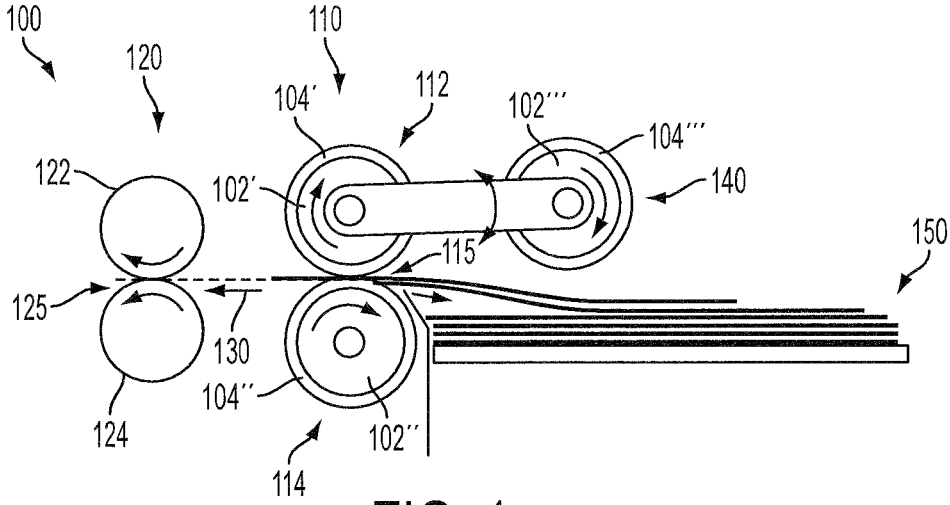
FIG. 1 schematically illustrates a media feeding assembly, according to various embodiments of the present teachings.
Figure 2:
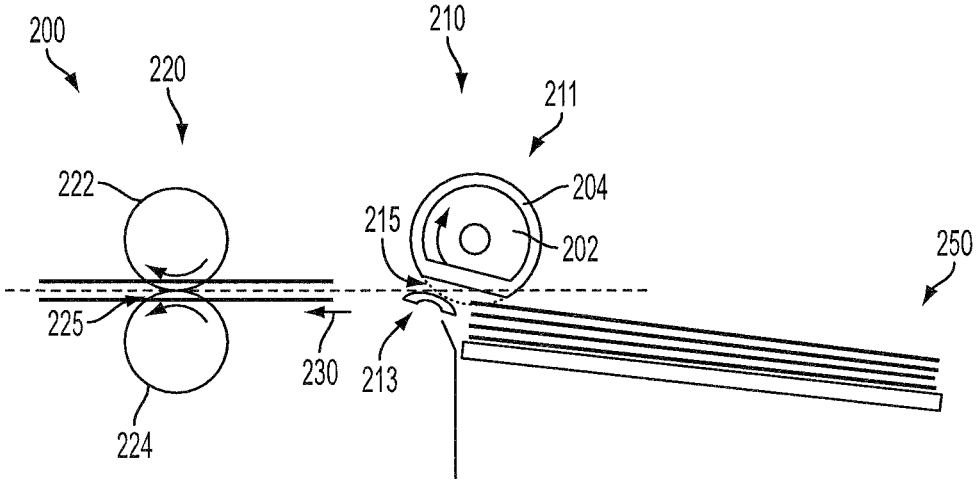
FIG. 2 schematically illustrates another exemplary media feeding assembly, according to various embodiments of the present teachings.

FIGS. 1 and 2 schematically illustrate exemplary media feeding assemblies 100, 200 in accordance with various embodiments of the present teachings. The media feeding assemblies 100, 200 can include a first drive roll configuration 110, 210 having a first nip 115, 215 disposed along an axis of a media feed path 130, 230 and a second drive roll configuration 120, 220 having a second nip 125, 225 disposed at a distance from the first drive roll configuration 110, 210. In some embodiments, the first drive roll configuration 110 can include one or more rolls, such as for example, a feed roll, 112, a retard roll 114, and a nudger roll 140, as shown in FIG. 1. In other embodiments, the first drive roll configuration 210 can include a D shaped feed roll 211 and a retard pad 213 as shown in FIG. 2. In various embodiments, the second drive roll configuration 120, 220 can have one or more rolls, such as, for example, take away rolls 122, 124, 222, 224.

Figure 3:
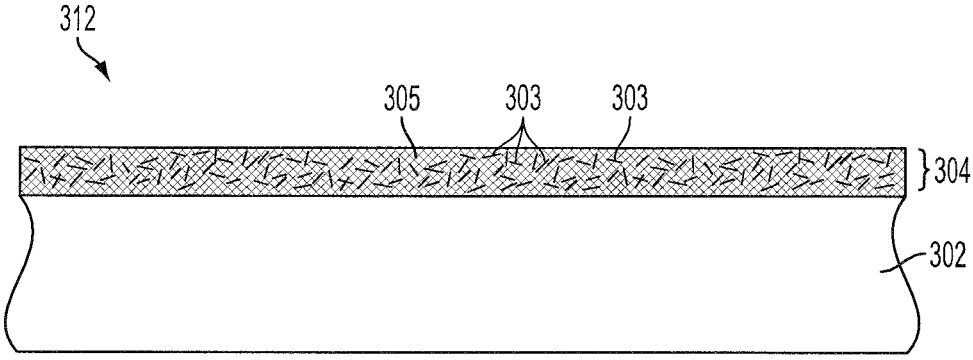
FIG. 3 schematically illustrates a cross section of an exemplary roll of the media feeding assembly shown in FIGS. 1 and 2, according to various embodiments of the present teachings.
Figure 4:
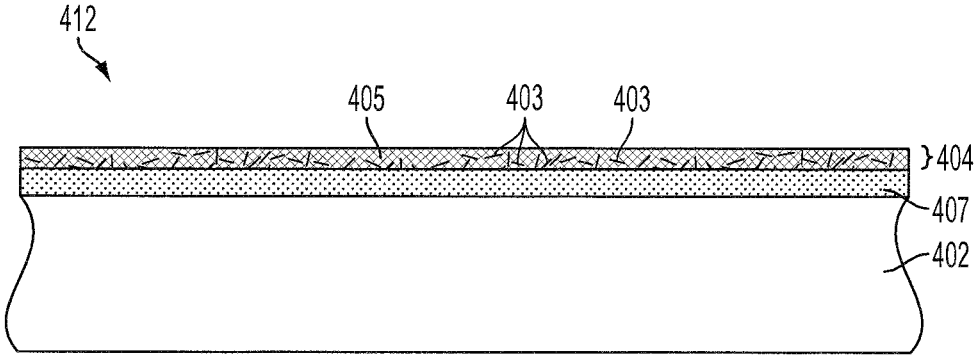
FIG. 4 schematically illustrates a cross section of another exemplary roll of the media feeding assembly shown in FIGS. 1 and 2, according to various embodiments of the present teachings.

In various embodiments, one or more rolls 112, 114, 122, 124, 140, 211, 213, 222, 224 of the first 110, 210 and the second 120, 220 drive roll configurations can include a composite rubber tire 104', 104", 104'", 204 disposed over a roll core 102', 102", 102'", 202, as shown in FIGS. 1 and 2. FIG. 3 shows a cross section of an exemplary roll 312 of the first 110, 210 and the second 120, 220 drive roll configurations of the media feeding assemblies 100, 200, the exemplary roll 312 can include a composite rubber tire 304 disposed over a roll core 302; the composite rubber tire 304 can include a plurality of soluble carbon nanotubes 303 dispersed in a first elastomeric rubber 305 to provide an increased wear resistance without a significant increase in hardness. FIG. 4 shows a cross section of another exemplary roll 412 of the first 110, 210 and the second 120, 220 drive roll configurations of the media feeding assemblies 100, 200. The exemplary roll 412 can include a second elastomeric rubber 407 disposed over a roll core 402 and a composite rubber tire 404 disposed over the second elastomeric rubber 407. In various embodiments, the composite rubber tire 404 can include a plurality of soluble carbon nanotubes 403 dispersed in the first elastomeric rubber 405. In some embodiments, the plurality of soluble carbon nanotubes 303, 403 dispersed in the first elastomeric rubber 305, 405 can provide at least about 10% reduction in wear without a significant increase in hardness. In some embodiments, the plurality of soluble carbon nanotubes 303, 403 dispersed in the first elastomeric rubber 305, 405 can provide at least about 15% reduction in wear without a significant increase in hardness. As used herein the term "wear" refers to a change in a diameter of the rubber tire of the one or more rolls of the first and the second drive roll configurations per media fed due to abrasion between the tire and the media during use. In some cases, the composite rubber tire 304, 404 can have a thickness in the range of about 100 μm to about 5000 μm and in other cases from about 1000 μm to about 2000 μm. In various embodiments, the second elastomeric rubber 407 can have a thickness in the range of about 500 μm to about 5000 μm and in other embodiments from about 1000 μm to about 2000 μm.

The roll 312, 412 can include any suitable first 305, 405 and the second 407 elastomeric rubber such as, for example, polyurethane, silicone, ethylene propylene diene M-class rubber, butyl rubber and any combination of these materials. Furthermore, the plurality of carbon nanotubes 303, 403 can be present in the first elastomeric rubber 305, 405 in an amount ranging from about 0.1 weight % to about 10 weight % of the total weight of the carbon nanotubes 303, 403 and the first elastomeric rubber 305, 405, and in some cases from about 0.1 weight % to about 5 weight % of the total weight of the carbon nanotubes 303, 403 and the first elastomeric rubber 305, 405.

As used herein, the term "soluble carbon nanotubes" refer to those carbon nanotubes that have been modified to make them more compatible with the first elastomeric rubber 305 or a solvent. Furthermore, the use of soluble carbon nanotubes improves their dispersion and the composite rubber tire's mechanical properties. Also, as used herein, the phrase "soluble carbon nanotubes are substantially uniformly dispersed in the composite rubber composition" refers that the majority of the soluble carbon nanotubes are individually dispersed in the composite rubber composition without any significant agglomeration. There are several approaches to modify carbon nanotubes to solubilize them or make them more compatible with an elastomeric rubber or a solvent. One approach is to co-valently form a chemical bond to the carbon nanotube. This approach essentially creates defects on the carbon nanotube and very often destroys desired properties. Another approach is to use surfactants such as sodium dodecyl sulfate and elastomeric rubbers. Yet another approach is to solubilize carbon nanotubes by wrapping a molecular or polymeric chain onto a carbon nanotube. Examples of these soluble carbon nanotubes can be found in NanoSolve® products (Zyvex Performance Materials, Columbus, Ohio), or DNA as used by DuPont (Wilmington, Del.). In the case of solubilization achieved by wrapping a molecular or polymeric chain, such as, for example, an elastomeric rubber onto the carbon nanotube, the solubilization enhances solubility in a solvent and dispersity in the elastomeric rubber. Although such an approach may perturb the electronic property of the carbon nanotube, it represents a good compromise. Chen et al. in Journal of American Chemical Society, 124, 9034-9035, 2002, describe a method of forming a soluble carbon nanotube complex via p-p interaction by reacting carbon nanotubes with poly(aryleneethynylene) in chloroform, the disclosure of which is incorporated by reference herein in its entirety. Through p-p interactions, the aromatic elastomeric rubber chains interact with the carbon nanotubes to de-bundle the carbon nanotubes. This process thus enables the resulting solublized carbon nanotubes to form a good dispersion in a solvent as well as in any polymer or a base elastomeric rubber. In some embodiments, solubilization can be achieved by complexation between the carbon nanotube and the elastomeric rubber, without functionalizing the carbon nanotube with a functional group. However, any suitable method can be used to solubilize carbon nanotubes.

Carbon nanotubes can be synthesized by any suitable method, including, but not limited to, arc discharge or laser ablation of graphite, chemical vapor deposition (CVD), and frame synthesis technique. Depending on the method of synthesis, reaction conditions, temperature, and many other parameters the carbon nanotube can have just one wall, characterized as a single walled carbon nanotube, it can have two walls, characterized as a double walled carbon nanotube, or can be a multi-walled carbon nanotube. The purity, chirality, length, defect rate, etc. can vary. Very often, after the carbon nanotube synthesis, there can occur a mixture of tubes with a distribution of all of the above, some long, some short. Some of the carbon nanotubes will be metallic and some will be semiconducting. Single wall carbon nanotubes can be about 1 nm in diameter whereas multi-wall carbon nanotubes can measure several tens nm in diameter, and both are far thinner than their predecessors, which are called carbon fibers. It will be appreciated that differences between carbon nanotube and carbon nano fiber is decreasing with the rapid advances in the field.

Furthermore, carbon nanotubes can include ones that are not exactly shaped like a tube, such as, for example, a carbon nanohorn (a horn-shaped carbon nanotube whose diameter continuously increases from one end toward the other end) which is a variant of a single-wall carbon nanotube; a carbon nanocoil (a coil-shaped carbon nanotube forming a spiral when viewed in entirety); a carbon nanobead (a spherical bead made of amorphous carbon or the like with its center pierced by a tube); a cup-stacked nanotube; and a carbon nanotube with its outer periphery covered with a carbon nanohorn or amorphous carbon.

Additionally, carbon nanotubes can include ones that contain some substances inside, such as: a metal-containing nanotube which is a carbon nanotube containing metal or the like; and a peapod nanotube which is a carbon nanotube containing a fullerene or a metal-containing fullerene.

As described above, in the present teachings, it is possible to employ carbon nanotubes of any form, including common carbon nanotubes, variants of the common carbon nanotubes, and carbon nanotubes with various modifications. Therefore, the concept of "carbon nanotube" in the present teachings encompasses all of the above and "soluble carbon nanotubes" can include one or more of the above carbon nanotubes.

In accordance with various embodiments, there is a printing apparatus including at least one of the media feeding assemblies shown in FIGS. 1 and 2.

Figure 5:
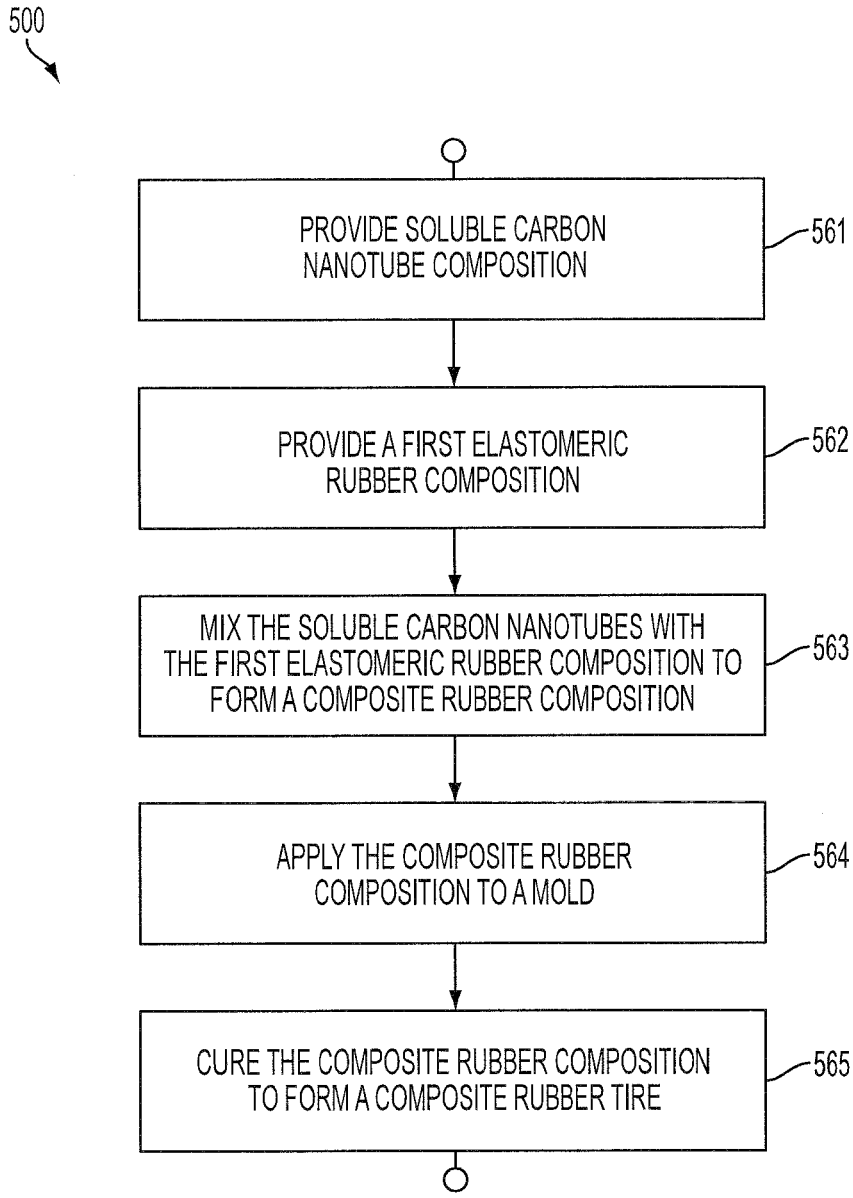
FIG. 5 shows an exemplary method of making a roll of a media feeding assembly, according to various embodiments of the present teachings.

In accordance with various embodiments, there is a method 500 of making a roll of a media feeding assembly, as shown in FIG. 5. The method 500 can include a step 561 of providing a soluble carbon nanotube composition and a step 562 of providing a first elastomeric rubber composition. The method 500 can also include a step 563 of mixing the soluble carbon nanotube composition with first elastomeric rubber composition to form a composite rubber composition, such that the soluble carbon nanotubes are substantially uniformly dispersed in the composite rubber composition. The method 500 can further include a step 564 of applying the composite rubber composition to a mold, followed by a step 565 of curing the composite rubber composition to form a composite rubber tire, such that the substantially uniformly dispersed soluble carbon nanotubes in the composite rubber provide an increased wear resistance without a significant increase in hardness. A roll core metal can then be inserted into a core of the composite rubber tire. In various embodiments, the composite rubber tire can include one or more of a plurality of soluble single wall carbon nanotubes, a plurality of soluble double wall carbon nanotubes, and a plurality of soluble multi-wall carbon nanotubes substantially uniformly dispersed in at least one of polyurethane, silicone, ethylene propylene diene M-class rubber, butyl rubber, and any combination of these materials. In some embodiments, the step 564 of applying the composite rubber composition to a mold can include applying the composite rubber composition over a roll core using a molding technique such as, for example, injection molding and compression molding and the step 565 of curing the composite rubber composition can include curing the composite rubber composition to form a composite rubber tire over the roll core. In various embodiments, the step 564 of applying the composite rubber composition over a roll core can include applying a second elastomeric rubber composition to a mold and applying the composite rubber composition over the second elastomeric rubber composition. In some embodiments, the step 564 of applying the composite rubber composition over a roll core can include applying a second elastomeric rubber composition to a mold, curing the second elastomeric rubber composition to form a second elastomeric rubber tire and applying the composite rubber composition over the second elastomeric rubber tire.

Figure 6:
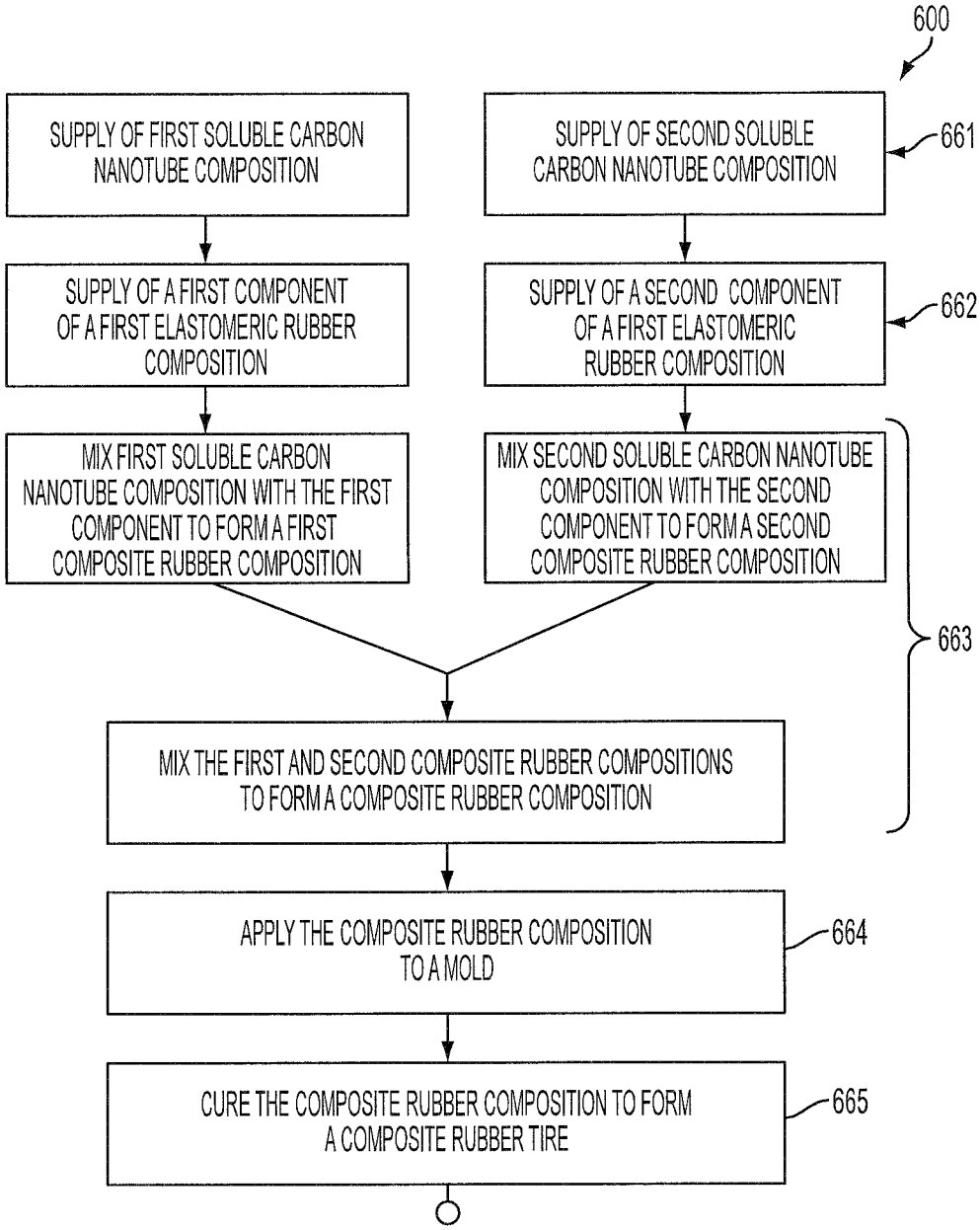
FIG. 6 shows another exemplary method of making a roll of a media feeding assembly, according to various embodiments of the present teachings.

FIG. 6 shows another method 600 of making a roll of a media feeding assembly in accordance with various embodiments. The method 600 can include a step 661 of providing a first soluble carbon nanotube composition and a second soluble carbon nanotube composition. In some embodiments, the second soluble carbon nanotube composition can differ from the first soluble carbon nanotubes in at least one of composition and concentration. In other embodiments, the second soluble carbon nanotubes can be the same as the first soluble carbon nanotubes. The method 600 can include a step 662 of providing two components: a first component and a second component of a first elastomeric rubber composition. In some embodiments, the step 662 of providing the first component of the first elastomeric rubber composition can include providing one or more of isocyanate, diorganopolysiloxane, ethylene, propylene, and isobutylene. In other embodiments, the step 662 of providing the second component of the first elastomeric rubber composition can include providing one or more of polyol, diorganosiloxane, diene, and isoprene. The method 600 can also include a step 663 of mixing the first soluble carbon nanotube composition with the first component of the first elastomeric rubber composition to form a first composite rubber composition, mixing the second soluble carbon nanotube composition with the second component of the first elastomeric rubber composition to form a second composite rubber composition, and mixing the first composite rubber composition with the second composite rubber composition to form a composite rubber composition, wherein the first and the second soluble carbon nanotubes are substantially uniformly dispersed in the composite rubber composition. In some embodiments, the method 600 can include a step 663 of mixing at least one of the first and the second soluble carbon nanotube composition with at least one of the first component or the second component of the first elastomeric rubber composition. The method 600 can also include a step 664 of applying the composite rubber composition to a mold and a step 665 of curing the composite rubber composition to form a composite rubber tire. In various embodiments, the method 500, 600 of making a roll of a media feeding assembly can be extended to multi-component first elastomeric rubber composition, wherein one or more soluble carbon nanotube composition can be mixed with one or multiple components of the first elastomeric rubber composition.

Figure 7:
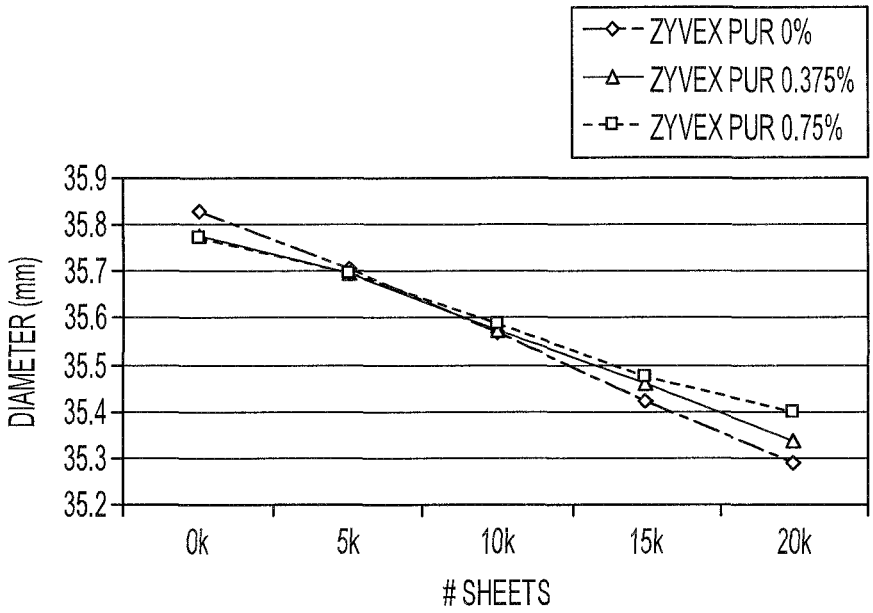
FIG. 7 shows the effect of adding carbon nanotubes on the feed roll wear, in accordance with various embodiments of the present teachings.

FIG. 7 shows the effect of adding the soluble carbon nanotubes to a feed roll sample including polyurethane tire. Three feed rolls having polyurethane tires were made, with one as a baseline sample with 0 weight % of soluble carbon nanotubes (NanoSolve® from Zyvex Performance Materials, Columbus, Ohio) and two with composite polyurethane tires having about 0.375 weight % and about 0.75 weight % of soluble carbon nanotubes (NanoSolve® from Zyvex Performance Materials, Columbus, Ohio) substantially uniformly dispersed in polyurethane. The baseline sample had an accelerated wear rate of 2.71E-5 tire diameter loss per sheet fed. Adding about 0.375% and about 0.75% by weight of the soluble carbon nanotubes reduced the wear rate to about 2.21E-5 diameter loss per sheet fed (about 18% reduction) and about 1.89E-5 diameter loss per sheet fed (about 30% reduction) respectively over the baseline feed roll polyurethane sample. The results shown in FIG. 7 indicate that the incorporation of soluble carbon nanotubes can greatly improve wear resistance.

While the invention has been illustrated respect to one or more implementations, alterations and/or modifications can be made to the illustrated examples without departing from the spirit and scope of the appended claims. In addition, while a particular feature of the invention may have been disclosed with respect to only one of several implementations, such feature may be combined with one or more other features of the other implementations as may be desired and advantageous for any given or particular function. Furthermore, to the extent that the terms "including", "includes", "having", "has", "with", or variants thereof are used in either the detailed description and the claims, such terms are intended to be inclusive in a manner similar to the term "comprising." As used herein, the phrase "one or more of", for example, A, B, and C means any of the following: either A, B, or C alone; or combinations of two, such as A and B, B and C, and A and C; or combinations of three A, B and C.

Other embodiments of the invention will be apparent to those skilled in the art from consideration of the specification and practice of the invention disclosed herein. It is intended that the specification and examples be considered as exemplary only, with a true scope and spirit of the invention being indicated by the following claims.

What is claimed is:

1. A media feeding assembly comprising:

a first drive roll configuration having a first nip disposed along an axis of a media feed path, the first drive roll configuration comprising one or more rolls; and a second drive roll configuration having a second nip disposed at a distance from the first drive roll configuration, the second drive roll configuration comprising one or more rolls, wherein the one or more rolls of the first and the second drive roll configurations comprise a composite rubber tire over a roll core, the composite rubber tire comprising a plurality of carbon nanotubes dispersed in a first elastomeric rubber in an amount to provide at least about 10% decrease in wear, wherein the plurality of carbon nanotubes comprises a plurality of soluble carbon nanotubes complexed to the first elastomeric rubber, wherein the plurality of soluble carbon nanotubes comprises a plurality of soluble single wall carbon nanotubes and one or more of a plurality of soluble double wall carbon nanotubes and a plurality of soluble multi-wall carbon nanotubes, and wherein the first elastomeric rubber is selected from a group consisting of polyurethane, silicone, ethylene propylene diene M-class rubber, butyl rubber, and mixtures thereof.

2. The media feeding assembly of claim 1, wherein the one or more rolls of the first and the second drive roll configurations further comprises:

a second elastomeric rubber disposed over the roll core, wherein the composite rubber is disposed over the second elastomeric rubber.

3. The media feeding assembly of claim 2, wherein the second elastomeric rubber is selected from a group consisting of polyurethane, silicone, ethylene propylene diene M-class rubber, butyl rubber, and mixtures thereof.

4. The media feeding assembly of claim 1, wherein the plurality of soluble carbon nanotubes are present in an amount ranging from about 0.1 weight % to about 10 weight % of the total weight of the carbon nanotubes and the first elastomeric rubber.

5. The media feeding assembly of claim 1, wherein the first drive roll configuration comprises a feed roll, a retard roll, and a nudger roll.

6. The media feeding assembly of claim 1, wherein the first drive roll configuration comprises D shaped feed roll and a retard pad.

7. A printing apparatus comprising the media feeding assembly of claim 1.

8. The media feeding assembly of claim 1, wherein the carbon nanotubes further comprise one or more of carbon nanohorn, carbon nanocoil, carbon nanobead, cup-stacked nanotubes, carbon nanotubes that have an outer periphery covered with a carbon nanohorn, and a carbon nanotubes that have an outer periphery covered with amorphous carbon.

9. The media feeding assembly of claim 1, wherein the carbon nanotubes further comprise one or more of metal containing nanotubes or peapod nanotubes.

* * * * *